United States Patent [19]

Sannel

[11] Patent Number: 4,673,251

[45] Date of Patent: Jun. 16, 1987

[54] APPARATUS AND METHOD FOR TRANSPORTING PHOTOSENSITIVE SHEETS IN A PHOTOPROCESSOR

[75] Inventor: Benjamin H. Sannel, St. Louis Park, Minn.

[73] Assignee: Pako Corporation, Minneapolis, Minn.

[21] Appl. No.: 810,408

[22] Filed: Dec. 18, 1985

[51] Int. Cl.[4] ..... G03D 3/08

[52] U.S. Cl. ..... 354/322; 226/108

[58] Field of Search ..... 354/319, 320, 321, 322, 354/318; 226/108, 111, 118

[56] References Cited

U.S. PATENT DOCUMENTS

| | | | |
|---|---|---|---|
| 3,465,663 | 9/1969 | Calder | 354/319 |
| 3,615,061 | 6/1969 | Bagdasarian | 354/319 |
| 3,743,195 | 7/1973 | Bagdasarian | 226/118 |
| 4,294,533 | 10/1981 | Bratt et al. | 354/318 |

OTHER PUBLICATIONS

Information on Torrington Drawn Cup Roller Clutches, p. 184 from Torrington Catalog.

1984 Thomas Register Catalog of Companies, pp. 7305, 7308.

Illustrated Parts List, Pako 26-TQ Processor, Pako Corporation, printed 3/85.

*Primary Examiner*—Alan Matthews

*Attorney, Agent, or Firm*—Kinney & Lange

[57] ABSTRACT

A processor for use in processing sheets of photosensitive material has a plurality of processing stations. A plurality of drive rollers define a sheet processing path through the processing stations and are driven to transport a sheet of photosensitive material along that path. The drive rollers at the processing station at the end of the path are driven at a faster rate of rotation than the drive rollers at previous processing stations along the path. The drive rollers of those previous processing stations, however, are mounted to permit said rollers to overrun their driven slower rate of rotation and permit those rollers to rotate at the faster rate of rotation.

9 Claims, 5 Drawing Figures

APPARATUS AND METHOD FOR TRANSPORTING PHOTOSENSITIVE SHEETS IN A PHOTOPROCESSOR

BACKGROUND OF THE INVENTION

1. Field of the Invention

The present invention relates to transport arrangements for photosensitive material in a processor, and specifically to an arrangement to eliminate excessive tension on the photosensitive material during movement thereof through a processor.

2. Description of the Prior Art

The processing of photosensitive materials typically requires that the materials be saturated with various development chemicals. Once a sheet of photosensitive material has been exposed to such chemicals, it then must be dried for use in creating prints and copies of the image borne thereon.

Photosensitive material processors have been developed which feed a sheet of photosensitive material through the necessary chemicals in an orderly fashion and then dry the sheet for further use. Typically, this sheet is driven by engagement with various rollers or matched roller pairs to follow a desired processing path. Each sheet of photosensitive material will bear one or more unique photographic images, which are often incapable of being reproduced in exactly the same form. Thus, great care must be used in handling such sheets.

In many cases, the sheet of photosensitive material is in the form of a roll or long sheet which must be processed. As fed through the processor, therefore, portions of the sheet may be in contact with all of the rollers along the processing path at the same time. The path is typically serpentine in nature, so that the sheet can be dipped into tanks of the various processing chemicals as it passes along the processing path. Because of the bends in the path, excessive tension is at times placed on the processing material as it travels from roller to roller.

In some processors, the processing fluid tanks are removable and not securely fastened to the processor. The tension placed on the processing material can not only damage the material, but also cause the pulling together of rollers and processing tanks which can cause the tanks to dump over. Neither of these results is desirable because of the great potential for damage to the unique photographic images borne by the photosensitive material.

Potential solutions to this problem include slower transport times for the processing material through the processor to thereby reduce the amount of tension placed on the material. In addition, slippery or low-friction rollers have been used in an attempt to reduce the tension placed on the photosensitive material by allowing the material to slip over those rollers, even though those rollers are driven to drive the paper along the processing path. These solutions proved inadequate. Slower running times reduces the productivity of a film processor and allowing the processing material to slip over rollers increases the chance for scratching and damage to the material as it is processed. A photosensitive material processing drive arrangement is thus needed which will maintain the material in tension as it passes through the processor to eliminate excessive looping, but which does not place excessive tension on the material to cause damage thereto or tipping of the processing fluid tanks in the processor.

SUMMARY OF THE INVENTION

The present invention is an improved apparatus and method for transporting sheets of photosensitive material in a photoprocessor. Excessive tension on the photosensitive material during processing is eliminated by using the apparatus and method of the present invention.

A typical processor for sheets of photosensitive material has a plurality of processing stations for those sheets, a plurality of drive rollers which define a sheet processing path through the processing station from a first end of the processor to a second end thereof, and drive means for rotating the rollers to transport the sheets along that path.

In the apparatus form of the present invention, means are provided for rotating a first set of drive rollers at selected processing stations adjacent the second end of the processor at a faster rate of rotation than the driven rate of rotation of a second set of the drive rollers at the other processing stations in the processor. Bearing means are then associated with each roller of the second set of rollers for permitting each said roller to overrun its driven rate of rotation.

The drive means preferably includes motor means, a drive shaft driven by the motor means and a plurality of rotation transfer means for translating rotation of the drive shaft into rotation of the drive rollers. The bearing means is associated with one of the rotation transfer means to permit the overrunning thereof relative to its drive shaft driven rate of rotation. The rotation transfer means includes a first gear secured on the drive shaft adjacent each processing station, a second gear mounted on a drive rotatable transfer shaft and which engages said first gear to be driven thereby, and a third gear fixedly mounted on said drive transfer shaft and operably connected to each roller of the second set of rollers. The bearing means then comprises a roller clutch mounted between the drive transfer shaft and the second gear to permit the drive transfer shaft to rotate at a rate faster than the driven rate of rotation of the second gear.

The improved method of the present invention for transporting sheets of photosensitive material in a processor which has a plurality of processing station includes the steps of transporting each sheet from a first station to a last station along a processing path which is defined by a plurality of rotating roller pairs, rotating at a first rate of rotation a first set of the rollerl pairs with said first set being defined by selective roller pairs extending from the first station to a selected station along the path and rotating at a second, faster rate of rotation a second set of the roller pairs with said second set being defined by selected roller pairs extending from said selected station to the last station along the path. The method further includes the step of permitting the roller pairs of the first set to overrun their driven rate of rotation and rotate at said second faster rate of rotation.

DETAILED DESCRIPTION OF THE PREFERRED EMBODIMENTS

Figure 1:
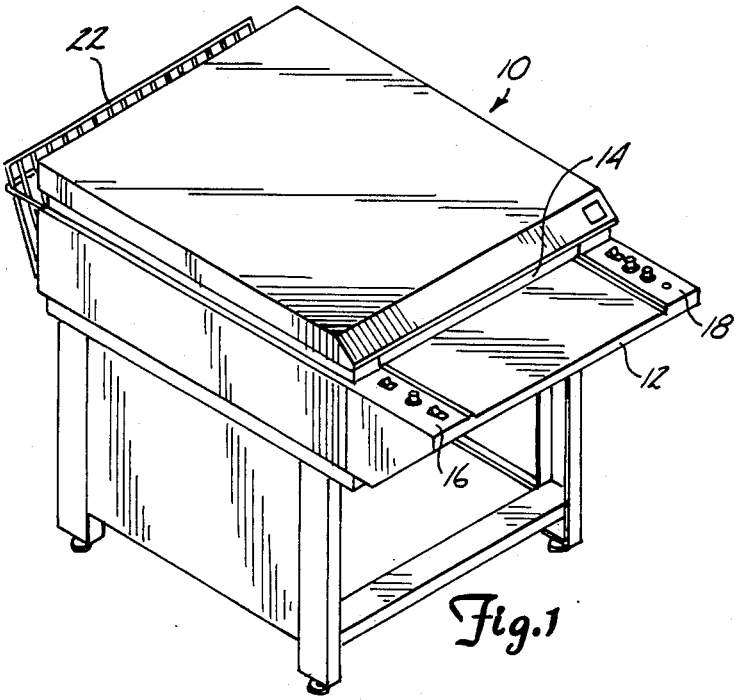
FIG. 1 is a perspective view of a graphic arts processor which utilizes the present invention.

FIG. 1 shows a graphic arts processor 10 which utilizes the improved photosensitive sheet transport system of the present invention. Processor 10 has a feed table 12 upon which sheets of photosensitive material are fed into the processor through entrance opening 14. Positioned on opposite sides of feed table 12 are left and rod control pods 16 and 18, respectively. The control pods include various manually operated switches and indicators for operator control of the processor 10.

The front end of the processor 10, including the feed table 12, entrance opening 14 and control pods 16 and 18, is located in a "dark room" to avoid light exposure of the sheets of photosensitive material being fed into the processor. The remaining portion of the processor 10 is preferably located on the opposite side of a wall (not shown) from the front end of the processor 10. The remainder of the processor does not have to be maintained in darkness, and the room in which the remainder of the processor 10 is located is preferably a "light room" rather than a "dark room."

Photosensitive sheets which have entered into the entrance opening 14 are transported through the processor 10, and are eventually driven out of a rear end thereof through an exit opening 20 (shown in FIG. 2) and into a catch tray or basket 21.

Figure 2:
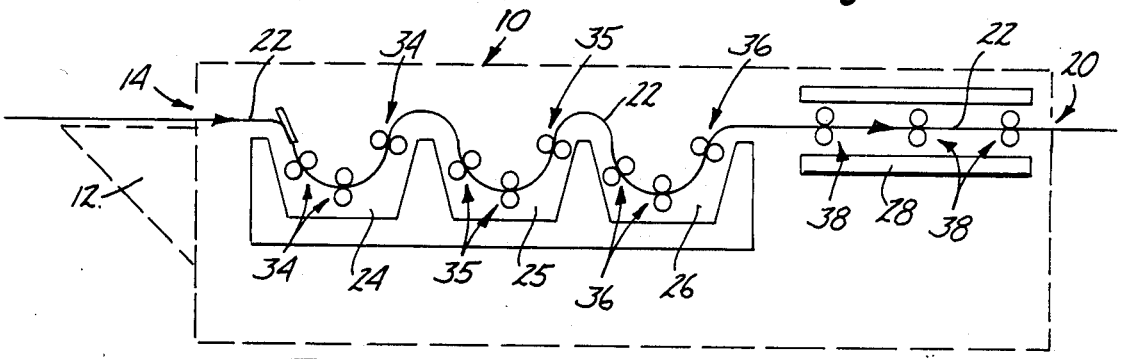
FIG. 2 is a schematic representation of the path of photosensitive sheets through the processor of FIG. 1.

In FIG. 2, a photosensitive sheet processing path 22 is shown as passing between a plurality of roller pairs located in various processing stations such as processing liquid tanks 24, 25, 26 and dryer portion 28 of the processor 10. These rollers pairs form a transport system for transporting sheets of photosensitive material through the processor 10 and define the sheet processing path 22, which extends from a first end of the processor (near entrance opening 14) to a second end thereof (near the exit opening 20). In a typical photoprocessor, liquid tank 24 contains developer solution, liquid tank 25 contains fix solution and liquid tank 26 contains wash solution. A photosensitive sheet is thus sequentially passed through the developer, fix and wash solutions to chemically process and develop the photographic images borne thereon. The sheet is then immediately passed through a dryer portion in the processor wherein tempered air is directed at the sheet from both sides so that the sheet is immediately dried for additional handling (e.g., printing of the images thereon).

As mentioned, the transport system for transporting the sheets of photosensitive material through the processor 10 include a plurality of roller pairs—roller pairs 34 adjacent the developer tank 24, roller pairs 35 adjacent the fix tank 25, roller pairs 36 adjacent the wash tank 26 and roller pairs 38 adjacent the dryer portion 28. Each roller pair consists of two drive rollers which are disposed laterally across the photosensitive sheet processing path 22 with the nip between each pair of rollers serving to define a portion of said path 22. Travel of a sheet along the path 22 is from left to right as viewed in FIG. 2.

Figure 3:
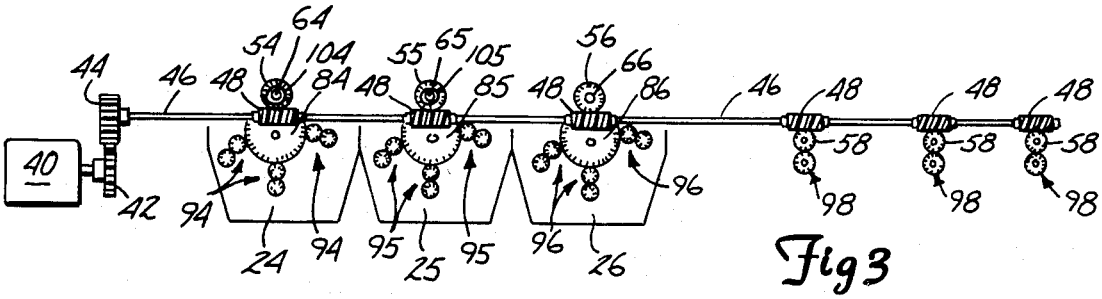
FIG. 3 is a schematic representation of the sheet drive system of the processor of FIG. 1.

The roller pairs 34, 35, 36 and 38 are rotatably driven and engage each sheet of photosensitive material to move it along the sheet processing path. A preferred arrangement for driving the roller pairs is shown in FIG. 3. A motor 40 rotates a motor gear 42, which engages and in turn rotates a drive shaft gear 44. Rotation of the drive shaft gear 44 in turn rotates of a main drive shaft 46 which extends along one side of the processor 10. A plurality of identical first worm gears 48 are mounted on the drive shaft, with at least one first gear 48 mounted on the main drive shaft 46 for each processing station (tanks 24, 25, 26 and drying portion 28). Each processing station also has at least one second gear associated with the drive roller pairs for that processing station and in driven engagement with one of the first gears 48. For convenience, the second gears shown in FIG. 3 are second gear 54 for developer tank 24, second gear 55 for fix tank 25, second gear 56 for wash tank 26 and a second gear 58 for each roller pair 38 in the dryer portion 28.

Figure 4:
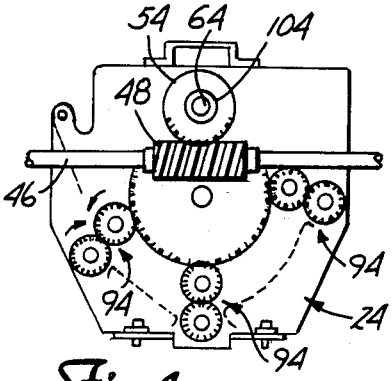
FIG. 4 is an enlarged view of the drive system at one fluid processing station of the processor.
Figure 5:
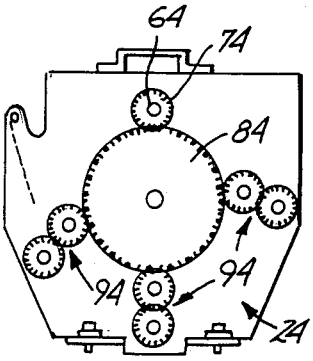
FIG. 5 is an enlarged view of the drive system at one fluid processing station of the processor, with some parts removed.

Each of the second gears 54, 55 and 56 adjacent its respective fluid processing station is mounted on a rotatable drive transfer shaft 64, 65, and 66, respectively. Enlarged views of the drive arrangement adjacent the developer tank 24 are shown in FIGS. 4 and 5. As shown in FIG. 5, a third gear 74 is fixedly mounted on the drive transfer shaft 64. The third gear 74 engages a fourth gear 84 which in turn engages gear pairs 94. Each gear of the gear pair 94 is shafted to one of the rollers of roller pair 34 of the developer tank 24. Thus, any rotation the gears of gear pair 94 rotates the rollers of roller pair 34 at the same rate of rotation. Each fluid processing station has a drive arrangement similar to that of the developer tank 24 shown in FIGS. 4 and 5 wherein a third gear (such as third gear 74 shown in FIG. 5) drives a fourth gear (fourth gears 85 and 86 for fix tank 25 and wash tank 26 are shown in FIG. 3) to drive gear pairs 94, 95 and 96 (the gears of each gear pair are in coupled engagement). The third gears for the fix tank 25 and wash tank 26 are not shown in the FIGS. Driven rotation of the main drive shaft 46 thus operates through the various gears described above to rotate the roller pairs 34, 35 and 36 at their respective fluid processing stations.

In the dryer portion 28, each roller of roller pair 38 is shafted to one of the gears of gear pair 98 (the gears of each gear pair 98 are in coupled engagement). One gear of each gear pair 98 is one of the second gears 58 which is in driven engagement with one of the first worm gears 48 of the main drive shaft 46. The rollers of each roller pair, the drive transfer shafts for each fluid processing station and the main drive shaft are all supported by suitable bearing means (not shown) on the processor 10. Thus, rotation of the main drive shaft 46 is translated into rotation of all of the roller pairs (via the various gears) so that when a photosensitive sheet is fed into the nip between a roller pair, it is engaged by the rollers and transported along the sheet processing path 22.

In many applications, the sheet of photosensitive material will comprise a roll of material (rather than a discrete sheet) and during processing, portions of the sheet will extend along the entire sheet processing path 22, such as seen in FIG. 2. Because of the serpentine nature of the sheet processing path 22, excessive tension is sometimes placed on the processing sheet as it travels through the processor. It is also important, however, that the sheet be maintained in tension during processing in order to avoid "looping" of the sheet.

To this end, the roller pairs 36 in the wash tank 26 and the roller pairs 38 in the dryer portion 28 are driven at a faster rate of rotation than the roller pairs 34 and 35 in the developer and fix tanks 24 and 25. This is achieved simply by making the second gears 56 and 58 identical and providing them with less gear teeth than the second gears 54 and 55 (which are also identical). While all of the second gears 54, 55, 56 and 58 are driven by identical first worm gears 48 rotating at the same rate of rotation, the difference in gear teeth between the second gears will cause the rollers driven by the second gears 56 and 58 to rotate at a faster rate of rotation than the rollers driven by the second gears 54 and 55. This is so even though the driven rate of rotation for the first worm gears 48 is identical (via rotation of the main drive shaft 46).

With this arrangement, a sheet of photosensitive material is driven along the processing path 22 faster at the wash tank 26 and dryer portion 28 than at the developer and fix tanks 24 and 25. For a sheet which is long or in roll form, the sheet will thus be in simultaneous engagement with rollers which are driven at different speeds. To prevent dragging of the sheet of photosensitive material over the slower driven rollers which are operably connected to the second gears 54 and 55 (the second gears with more teeth), a roller clutch 104 is mounted between the drive transfer shaft 64 and its second gear 54 and a roller clutch 105 is mounted between the drive transfer shaft 65 and its second gear 55. A suitable roller clutch for this purpose is the drawn cup roller clutch manufactured by the Torrington Co. (Bearings Division) of Torrington, Conn.

Each roller clutch transmits torque between its drive transfer shaft and its respective second gear in one direction and allows free overrun of the second gear with respect to the drive transfer shaft in the opposite direction. The roller clutch 104 permits the drive transfer shaft 64 to "overrun" the driven rate of rotation of the second gear 54 in the counterclockwise rotation direction as viewed in FIG. 4. Roller clutch 105 operates in a similar manner (as a one-way bearing) between drive transfer shaft 55 and second gear 55. This in turn permits the roller pairs 34 and 35 associated with each second gear 54 and 55 to rotate at a rate faster than they would otherwise be driven to rotate by their respective second gear. Thus, when a sheet of photosensitive material is drawn at a faster rate through the processor by engagement with the roller pairs 36 and 38 (which are rotated faster), the sheet is not dragged over the rollers pairs 34 and 35 (which are rotated slower), since the roller pairs 34 and 35 are permitted to overrun their driven rate of rotation and roll freely with the sheet as the sheet is pulled therethrough. With the improved transport system of the present invention, the possibility of damage to the sheets of unique photosensitive material during transport through the processor 10 is significanly lessened since excessive tension on the sheets is reduced and the sheets are not "dragged" over slower driven rollers.

Although the present invention has been described with reference to preferred embodiments, workers skilled in the art will recognize that changes may be made in form and detail without departing from the spirit and scope of the invention.

I claim:

1. In a processor of sheets of photosensitive material having a plurality of processing stations for the sheets, a plurality of drive rollers which define a sheet processing path through the processing stations from a first end of processor to a second end thereof, and drive means for rotating the rollers to transport the sheets along the path, the improvement which comprises:

means for rotating a first set of the drive rollers at selected processing stations adjacent to the second end of the processor at a faster rotation rate than the driven rotation rate of a second set of the drive rollers at the other processing stations; and bearing means associated with each roller of the second set of rollers for permitting said roller to overrun its driven rate of rotation.

2. The invention of claim 1 wherein the drive means includes motor means, a drive shaft driven by the motor means, and a plurality of rotation transfer means for translating rotation of the drive shaft into rotation of the drive rollers, and wherein the bearing means is associated with one of the rotation transfer means to permit the overrunning thereof relative to its drive shaft driven rate of rotation.

3. The invention of claim 2 wherein the rotation transfer means includes a first gear secured on the drive shaft adjacent each processing station, a second gear mounted on a rotatable drive transfer shaft and which engages said first gear to be driven thereby, and a third gear fixedly mounted on said drive transfer shaft and operably connected to each roller of the second set of rollers, and wherein the bearing means comprises:

a roller clutch mounted between the drive transfer shaft and the second gear to permit the drive transfer shaft to rotate at a rate faster than the driven rate of rotation of the second gear.

4. The invention of claim 1 wherein the drive means includes motor means, a drive shaft driven by the motor means, a plurality of identical first gears mounted on the drive shaft with at least one first gear mounted on the drive shaft for each processing station, and at least one second gear associated with the drive rollers of each processing station and in driven engagement with one of the processing station's first gears, and wherein the rotating means includes having each second gear which is operably connected to the first set of drive rollers having more gear teeth than each second gear which is operably connected to the second set of drive rollers.

5. The invention of claim 1 wherein the drive rollers are disposed in parallel pairs extending laterally across the processing path with the nip between each pair of rollers serving to define a portion of said path.

6. The invention of claim 1 wherein at times, portions of a sheet of photosensitive material extend along the entire sheet processing path during the processing of said sheet.

7. The invention of claim 1 wherein the processing stations include, in order of processing along the sheet processing path, a developer solution station, a fix solution station, a wash solution station, and a sheet drying station, with the wash solution station and sheet drying station being said selected processing stations adjacent the second end of the processor.

8. In a processor of sheets of photosensitive material having a plurality of fluid processing stations for photoprocessing the sheets, a drying station for drying the sheets, and a plurality of drive rollers which define a processing path for transporting the sheets sequentially through the fluid and drying stations of the processor, the improvement which comprises:

drive means for rotating a first set of the drive rollers at the drying station and at the fluid station adjacent thereto at a faster rate than a second set of the drive rollers at the other fluid stations; and bearing means associated with selected drive rollers of the second set of rollers for permitting said selected drive rollers to overrun their driven rate of rotation.

9. A method for processing sheets of photosensitive material in a processor which has a plurality of processing stations, the method comprising the steps of:

transporting each sheet from a first station to a last station along a processing path which is defined by a plurality of rotating roller pairs;

rotating at a first rate of rotation a first set of the roller pairs with said first set being defined by selected roller pairs extending from the first station to a selected station along the path;

rotating at a second, faster rate of rotation a second set of the roller pairs with said second set being defined by selected roller pairs extending from said selected station to the last station along the path; and permitting the roller pairs of the first set to overrun their driven first rate of rotation and rotate at said second faster rate of rotation.

* * * * *